US005217088A

United States Patent [19]

Dallman

[11] Patent Number: 5,217,088

[45] Date of Patent: Jun. 8, 1993

[54] SATELLITE BANKING UNIT FOR DRIVE-THROUGH BANK

[76] Inventor: Ernest R. Dallman, 9200 Fanchon Dr., Zionsville, Ind. 46077

[21] Appl. No.: 768,151

[22] Filed: Sep. 30, 1991

[51] Int. Cl.[5] ..... E04H 1/12

[52] U.S. Cl. ..... 186/37

[58] Field of Search ..... 186/35-37, 186/41, 53

[56] References Cited

U.S. PATENT DOCUMENTS

| | | | |
|---|---|---|---|
| 3,068,599 | 12/1962 | Myerson | 40/132 |
| 3,304,416 | 2/1967 | Wolf | 235/92 |
| 4,073,368 | 2/1978 | Mustapick | 186/1 C |
| 4,261,125 | 4/1981 | Rappaport | 40/367 |
| 4,436,182 | 3/1984 | Simonotti et al. | 186/37 |
| 4,557,352 | 12/1985 | Tschappat, Jr. | 186/37 |
| 4,675,515 | 6/1987 | Lucero | 235/381 |
| 4,735,289 | 4/1988 | Kenyon | 186/37 |
| 4,760,245 | 7/1988 | Fukaya | 235/379 |
| 4,852,847 | 8/1989 | Pagel | 248/548 |
| 4,858,876 | 8/1989 | Moreno | 248/545 |
| 4,884,662 | 12/1989 | Cho et al. | 186/36 |

FOREIGN PATENT DOCUMENTS 0193505 9/1986 European Pat. Off. .

*Primary Examiner*—Michael S. Huppert
*Assistant Examiner*—William M. Hienz
*Attorney, Agent, or Firm*—Barnes & Thornburg

[57] ABSTRACT

A satellite banking unit is provided for use with a drive-through bank teller station such as a bank teller window or an automatic teller machine. The unit includes a container and a base for supporting the container at an elevated position above the roadway so that the container is accessible to an occupant seated in a vehicle positioned alongside the container and waiting in line to approach the drive-through bank teller station. The container includes a dispenser for dispensing banking envelopes and the like to a customer in a vehicle alongside the container and a system for providing a message to that customer.

31 Claims, 4 Drawing Sheets

SATELLITE BANKING UNIT FOR DRIVE-THROUGH BANK

BACKGROUND AND SUMMARY OF THE INVENTION

This invention relates to a satellite banking unit for use by drive-through bank customers to obtain transaction information and papers in advance of reaching a drive-through bank teller station, and particularly to a banking services staging unit positioned one or more car lengths away from the transaction window of a drive-through bank. More particularly, this invention relates to a banking services staging unit configured to provide banking information and dispense banking materials to occupants of vehicles waiting in line to use the drive-through bank teller station.

Conventional drive-through banking requires customers in vehicles to get in line, drive up to a bank teller station, and complete a transaction at the station. In addition to waiting for each driver ahead in line to complete their transactions, invariably it seems that the customer at the bank teller station forgot the appropriate for or envelope for completing the transaction. This necessarily involves additional delays for other people in line while the bank supplies the necessary form or envelope at the bank teller station. In some cases, it is necessary for the customer to leave his vehicle in order to reach the form or envelope being presented by the bank at the bank teller station.

A remote dispensing unit located to dispense banking materials to customers waiting in line to use a drive-through bank teller station and one or more car lengths away from the bank teller station would be a great convenience to customers. A dispensing unit adapted to greet customers and transmit information usable to enable the customers to complete their banking transactions more quickly and efficiently would be appreciated by banks and customers alike. Such a remote dispenser could assist customers by enabling the customers to obtain, understand, and prepare transaction forms in advance while waiting in line and before reaching the bank teller station.

According to the present invention, a banking services staging apparatus is provided for getting a banking customer ready to use a drive-through bank teller station. The staging apparatus includes a remote service unit separate from an adjacent drive-through bank teller station, means for sensing the presence of a vehicle positioned alongside the remote service unit, means for presenting a message to a vehicle detected by the sensing means, and means for dispensing banking service materials to an occupant of a vehicle positioned alongside the remote service unit and detected by the sensing means.

In preferred embodiments, the remote service unit includes a container and base means for supporting the container at an elevated position above a roadway. The container is situated in a location remote from an adjacent drive-through bank teller station so that the container is accessible to an occupant seated in a vehicle positioned alongside the remote service unit and detected by the sensing means. The sensing means is an infrared sensor mounted in the container and aimed at a vehicle positioned alongside the container. Also, the presenting means illustratively includes a speaker mounted on the container for providing the transmission of a recorded message to the person in the vehicle alongside the container.

In use, upon approaching the remote service unit, a vehicle occupant first sees a backlit display panel on one side of the container bearing a message provided by the bank. The message could be marketing information, civic or public service announcements, or third party advertisements or the like. An infrared sensor recognizes the approach of an individual vehicle and triggers an audio message provided by recorded audio chips with client- supplied script when the vehicle is alongside the staging apparatus.

The remote service unit provides for one-handed operation of an envelope/form dispenser by the occupant of a vehicle positioned alongside the container, thus allowing the occupant of the vehicle to reach the required materials easily. Being remotely located one or more car lengths from the drive-through bank teller station, the occupant has time to read, understand, and prepare the materials for the transaction while waiting in line, rather than trying to accomplish all of those activities while waiting alongside the drive-through bank teller station, thereby saving time and aggravation for the occupants of other vehicles waiting in line.

In a preferred embodiment, the container is joined to a lower base support by a break-away swivel mounting. The break-away swivel mounting includes a circular mating section attached to the upper container part. This circular mating section fits into a rectangular mating section formed by the lower support part and is fastened thereto by use of frangible bolts. In the event that the remote service unit is struck by a vehicle, the break-away swivel mounting minimizes damage by allowing the upper container part to rotate without twisting or breaking the lower support part.

Other features of the staging apparatus include a lockable lid which rotatably opens to allow easy access by the bank personnel to restock the supply of banking materials or to change the message in the display panel. When closed, the lid cooperates with the container to form a means to vent heat from the interior of the container part. The staging apparatus also includes a neon light inside the container to backlight the message in the display panel and, through an aperture in the bottom of the upper container part, shine light around the base for security and appearance. It will be understood that a satellite banking unit in accordance with the present invention advantageously provides a means for dispensing banking materials in advance of reaching the bank teller station and by allowing easy access to those materials by placing them, and a pen for filing them out, at vehicle window level, obviating the need to get out of the vehicle to reach the materials.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
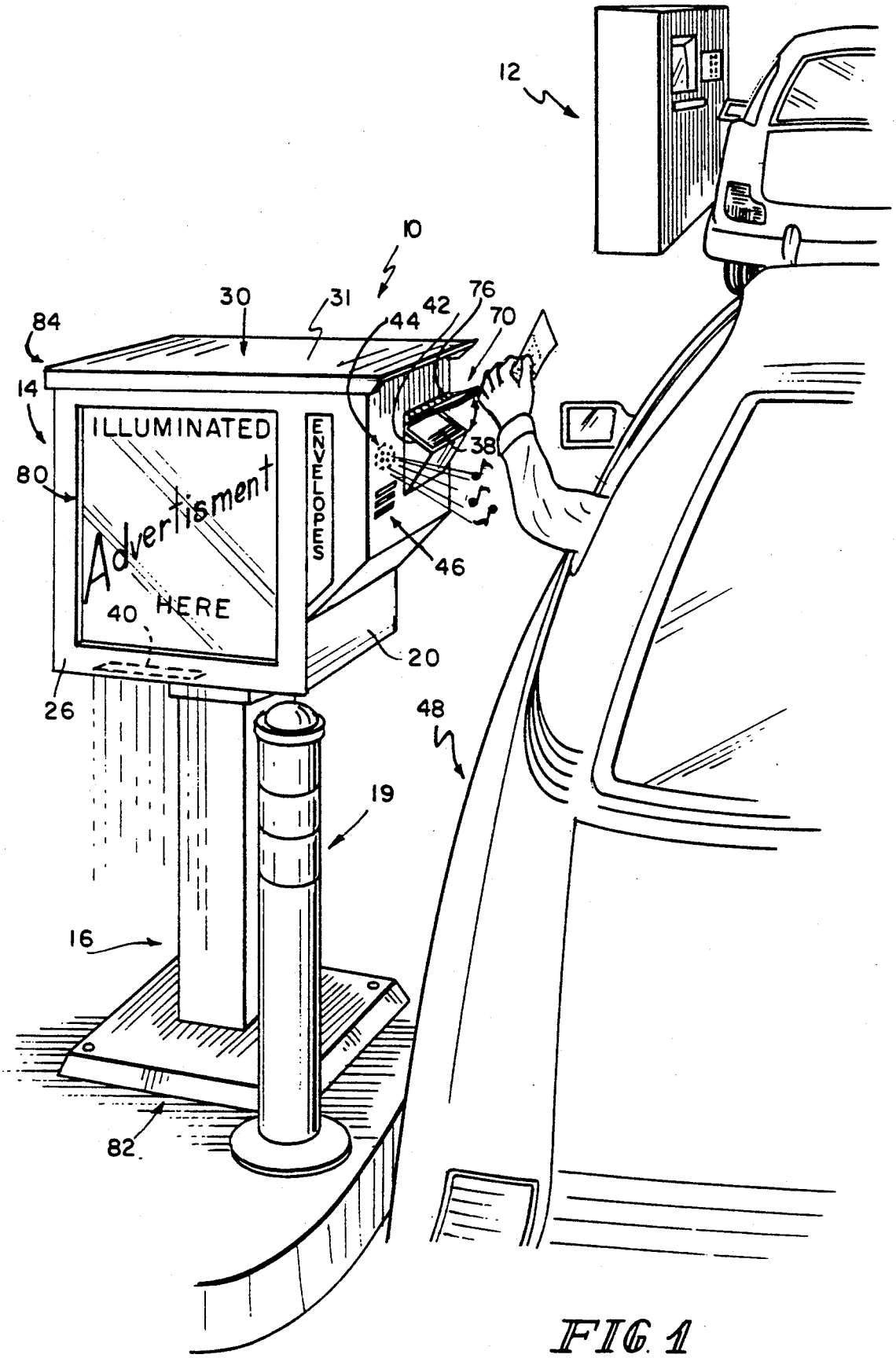
FIG. 1 shows a banking services staging apparatus in spaced-apart relation to a drive-through bank teller station.

The banking services staging apparatus 10 is shown in spaced-apart relation to a drive-through bank teller station 12, which could be a bank teller window or automatic teller machine or the like. The staging apparatus 10 comprises a container 14 joined to a support 16 by a break-away swivel mount 18. A ballard 19 is provided to aid customers in their approach and protect apparatus 10 from damage. The apparatus 10 and ballard 19 may be conveniently anchored in asphalt or concrete with furnished steel anchors (not shown). The container 14 is desirably made of hand-welded, seamless, heavy gauge stainless steel.

The container 14 comprises side walls 20, 22, 24, 26 appended to a bottom wall 28 having an aperture 40 wherein the side walls 20, 22, 24, 26 and bottom wall 28 cooperate with a lid 30 to form an interior region 32 which includes a light source 34 and an inclined shelf 36 for storing banking materials 38.

A first side wall is formed to include a discharge outlet 42, a plurality of holes 44 to act as a speaker grille, and a plurality of horizontally oriented rectangular slots 46 through which an infrared sensor (not shown) operates for detecting the presence of a vehicle 48. The inclined shelf 36 is oriented as shown, for example, in FIG. 2 so that a transverse plane 37 normal to the inclined shelf 36 is parallel to the lower face 43 of the discharge outlet 42, and the inclined shelf 36 is further arranged to provide means for conducting banking materials 38 stored thereon under gravity toward the discharge outlet 42. It is understood that the banking materials 38 could be urged toward the discharge outlet 42 by spring loading or other suitable means. In the embodiment of FIGS. 2–6, the inclined shelf 36 is fixed in a rigid position by a mounting bracket 35 coupled to bottom wall 28 as shown, for example, in FIG. 2.

Figure 7:
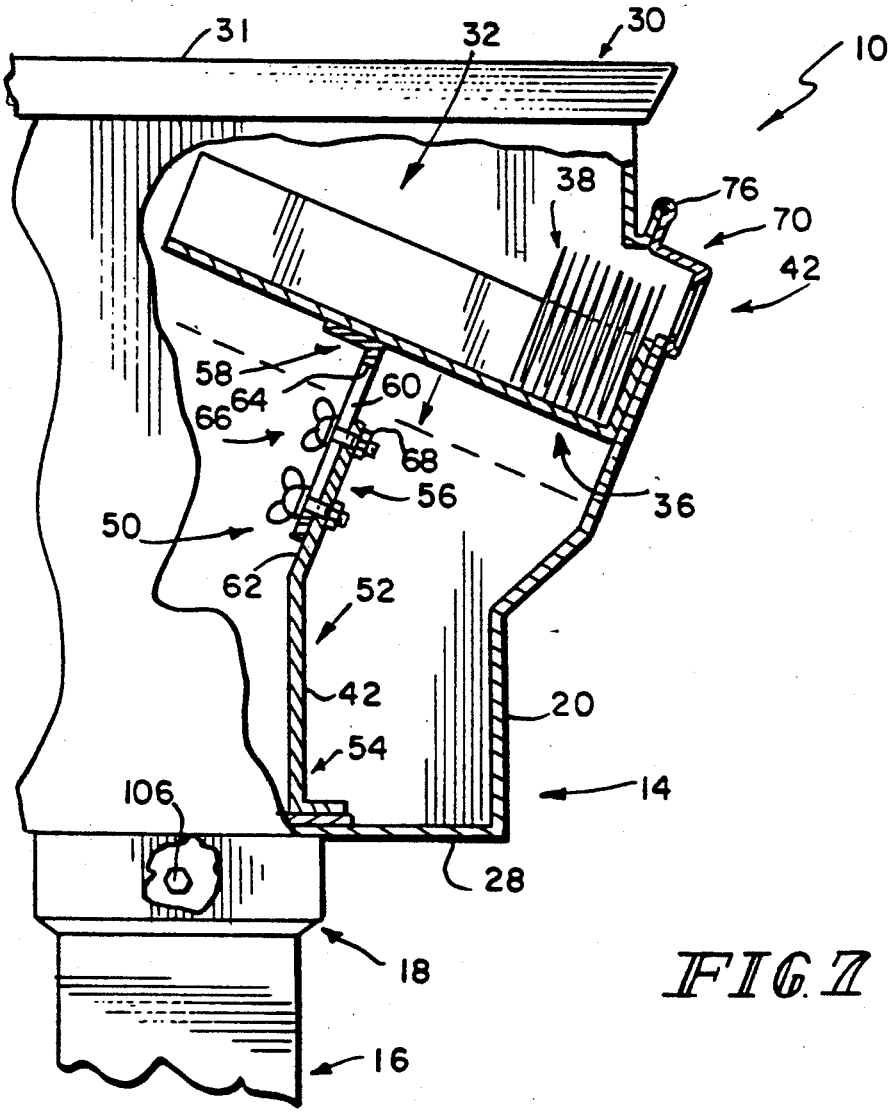
FIG. 7 shows an alternative embodiment wherein a banking materials storage tray provided inside the container is slidably adjustable to accommodate materials of various sizes.

In the embodiment of FIG. 7, the inclined shelf 36 is held in position adjacent the discharge outlet 42 by an adjustable mount 50 comprising a first bracket 52 and a second bracket 58. The first bracket 52 includes a lower portion 54 attached to the bottom wall 28 of the container 14 and oriented normal thereto, and an upper portion 56 oriented to be orthogonal to the plane of the inclined shelf 36. The second bracket 54 is attached to the inclined shelf 36 and is normal thereto. The first and second brackets 52, 58 are positioned so that the bottom facing surface 60 of the second bracket 58 comes into contact with the top facing surface 62 of the upper portion 56 of the first bracket 52.

The second bracket 58 is formed to include distal longitudinal slots 64 that are axially aligned with holes formed in first bracket 52 and cooperate to allow at least one threaded bolt 66 to pass therethrough to engage a fitting nut 68. The bolt 66 and nut 68 cooperate to press the contacting surfaces 60, 62 together, thereby holding the inclined shelf 36 in a user selected slidably adjustable position. All of said adjustable positions maintain the inclined shelf 36 adjacent to the discharge outlet 42 while accommodating banking materials 38 of various sizes.

Figure 2:
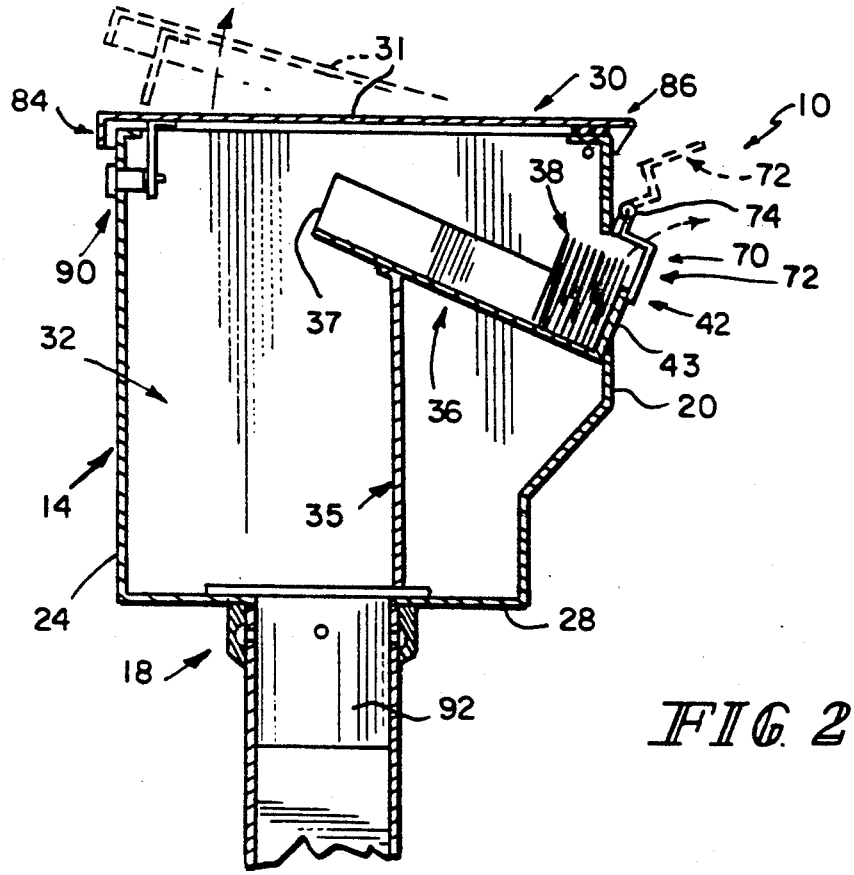
FIG. 2 is a sectional view of the staging apparatus of FIG. 1 showing the container, support post, and break-away swivel mounting of the staging apparatus.
Figure 3:
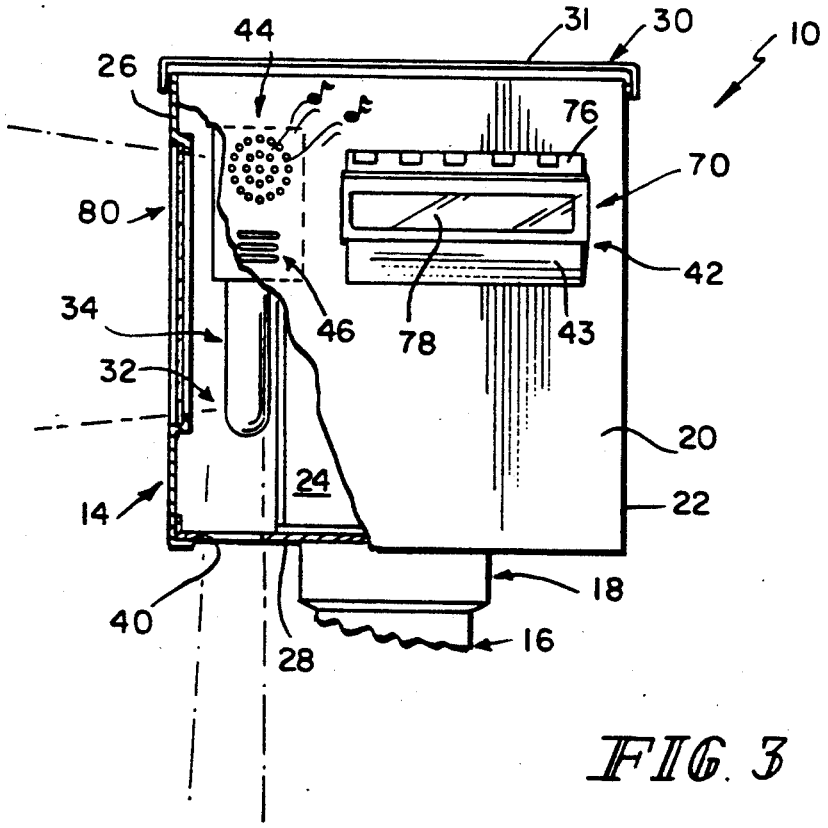
FIG. 3 is a front elevation view of the staging apparatus of FIG. 1, with the container being partially broken away to reveal the light source therein.
Figure 4:
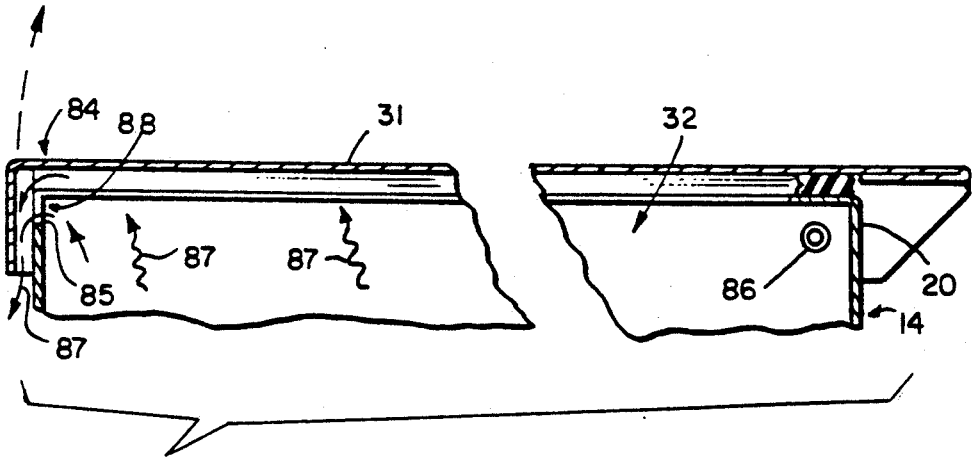
FIG. 4 is a section through the top of the container showing the lid and a container side wall cooperating to form a means for venting the interior of the container.

A gate 70 is mounted on the first side wall 20 and movable as shown best in FIG. 2 between a discharge outlet-opening position 72 and a discharge outlet-closing position 74. The gate 70 is rotatably moveable about a hinge 76 whose longitudinal axis lies in a horizontal plane, the axis also lying parallel to the first side wall 20. The gate 70 pivots and is shaped to keep rain or snow or the like from entering the interior region 32 of container 14 when the gate 70 is moved to its opened position 72. In one of the preferred embodiments, the gate 70 is formed to include a window 78 to allow a visual means of ascertaining the presence or absence of banking materials 38 at the discharge outlet 42.

A second side wall 26 is formed to include a backlit message display panel 80. The light source 34 projects light simultaneously onto the backlit message display panel 80 and through the aperture 40 in the bottom wall 28 to illuminate the base means 82 underlying the container 14. The display panel 80 is weather-sealed to keep the interior region 32 of container 14 clean and dry. The down light aids in visibility. The base 82 is a corrosion retardant solid steel base with baked enamel finish.

The container 14 is formed to include a loading inlet 84 facing away from the discharge outlet 42 wherein the lid 30 provides means for selectively opening the loading inlet 84 to permit a person standing alongside the back of the container 14 to gain access to the banking materials 38 contained therein. The lid 30 includes a closure member 31 and a hinge 86 about which the lid is rotatably moveable. In the lowered position the closure member 31 is in spaced-apart relation to the top edge 85 of the back side wall 24 as shown best in FIG. 4 to define a venting aperture 88 therebetween to discharge heat 87 developing in the container 14 while the loading inlet 84 is closed. The container 14 is also formed to include a lock 90 as shown in FIG. 2 that is positioned to engage the lid 30 when the lid 30 is in the closed position, thereby preventing unauthorized access to the interior region 32 of the container 14. This keyed locking system provides security and prevents tampering.

An infrared sensor (not shown) is mounted inside the container 14 behind the rectangular slots 46 formed in the first side wall 20. The infrared sensor is oriented to detect the presence of a vehicle 48 alongside the banking services staging apparatus 10. A speaker means (not shown) is mounted inside the container 14 and oriented to project an audio message through the plurality of holes 44. The audio message is triggered by the infrared sensor upon detection of a vehicle 48 alongside the staging apparatus 10. In other embodiments (not shown), visual messages could also be displayed.

Figure 5:
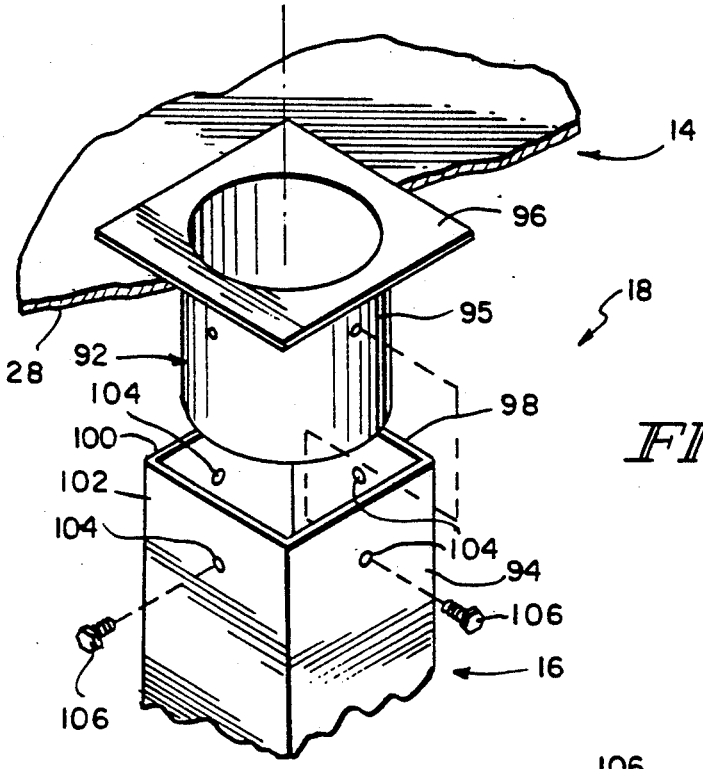
FIG. 5 is an exploded perspective view of the break-away swivel mounting provided with frangible bolts.
Figure 6:
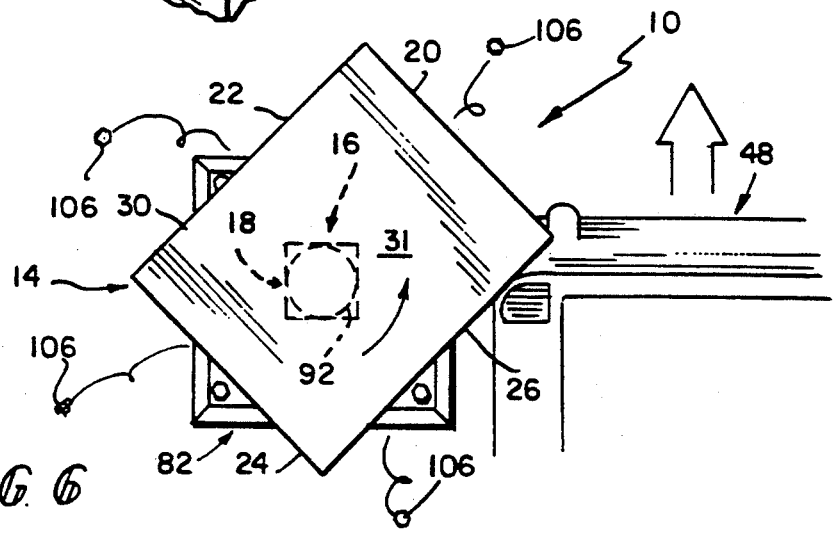
FIG. 6 depicts the container spinning about the break-away mount relative to the base following an impact between a vehicle and the container.

The break-away swivel mounting 18 comprises a first cylindrical mating section 92 and a second rectangular mating section 94, as shows best in FIG. 5, although the second rectangular mating section 94 could also be cylindrical. The first mating section 92 comprises a cylinder 95 attached to a flat plate 96 so that the longitudinal axis of the cylinder 95 is normal to the plate 96 and passes through the center thereof. The flat plate 96 is joined to the bottom wall 28 of the container 14. The second mating section 94 is formed by the side walls 98, 100, 102, 104 of the support 16, the inner surfaces of the side walls 98, 100, 102, 104 defining an area where the length and width of the area are approximately equal to the outside diameter of the cylinder 94, so that the longitudinal centerline of each side wall 98, 100, 102, 104 lies along the line of tangency between the cylinder 94 and the side walls 98, 100, 102, 104.

The first and second mating sections 92, 94 are formed to include a plurality of holes 104, one hole positioned on each line of tangency between the first and second mating sections 92, 94, wherein the holes of each mating section 92, 94 are aligned with those of the other mating section 92, 94 to allow a frangible bolt 106 to pass therethrough. During a collision between a vehicle and the staging apparatus 10, as shown, for example, in FIG. 6, the frangible bolts 106 shear, allowing the first cylindrical mating section 92 and the container 14 attached thereto to spin about the longitudinal axis of the first mating section 92 inside the second mating section 94 thereby minimizing damage to the container 14 and support 16. Illustratively, breakaway nylon screws can be used to provide frangible bolts 106, and these screws are designed to minimize the effect of possible impact by allowing the container 14 to turn about support 16.

Although the invention has been described in detail with reference to certain preferred embodiments, variations and modifications exist within the scope and spirit of the invention as described and defined in the following claims.

What is claimed is:

1. A banking services staging apparatus for readying a banking customer traveling in a vehicle to use a drive-through bank teller station in advance of reaching the teller station, the apparatus comprising a remote service unit separate from an adjacent drive-through bank teller station, means for sensing the presence of a vehicle positioned alongside the remote service unit, the sensing means being located in the remote service unit, means for presenting a message to a vehicle detected by the sensing means, the presenting means being located in the remote service unit, and means for dispensing banking services materials to an occupant of a vehicle positioned alongside the remote service unit and detected by the sensing means.

2. The staging apparatus of claim 1, wherein the remote service unit includes a container and base means for supporting the container at an elevated position above a roadway and remote from an adjacent drive-through bank teller station so that the container is accessible to an occupant seated in a vehicle positioned alongside the remote service unit and detected by the sensing means.

3. The staging apparatus of claim 2, wherein the sensing means and the presenting means are mounted in the container.

4. The staging apparatus of claim 2, wherein the dispensing means is mounted in the container.

5. The staging apparatus of claim 4, wherein the container is formed to include an interior region and includes a first side wall arranged to face a vehicle positioned alongside the remote service unit and detected by the sensing means, the first side wall is formed to include a discharge outlet and the dispensing means includes means for storing a collection of banking service materials inside the interior region adjacent to the discharge outlet formed in the first side wall and a gate mounted on the first side wall and movable between a discharge outlet-opening position and a discharge outlet-closing position.

6. The staging apparatus of claim 2, further comprising a backlit message display panel mounted on the container and means in the container for projecting light simultaneously onto the backlit message display panel on the container and onto the base means underlying the container.

7. The staging apparatus of claim 6, wherein the container is formed to include an interior region and includes a first side wall arranged to face toward a vehicle positioned alongside the remote service unit and detected by the sensing means and a second side wall arranged at an angle to the first side wall to face toward a vehicle approaching the remote service unit, the backlit message display panel is mounted on the second side wall, and the projecting means is mounted in the interior region of the container.

8. The staging apparatus of claim 7, wherein at least one of the sensing means, presenting means, and dispensing means is coupled to the first side wall to communicate with a vehicle positioned alongside the remote service unit.

9. The apparatus of claim 2, wherein the dispensing means includes means for storing a collection of banking service materials inside an interior region in the container, and the container is formed to include a discharge outlet accessible to an occupant of a vehicle positioned alongside the remote service unit and detected by the sensing means and a loading inlet facing away from the discharge outlet, the container includes lid means for selectively opening the loading inlet formed in the container to permit a person standing alongside the remote service unit to gain access to banking service materials contained in the storing means, and the dispensing means further includes closure means for selectively opening the discharge outlet formed in the container to permit an occupant of a vehicle positioned alongside the remote service unit to gain access to banking service materials contained in the storing means without using the lid means to open the loading inlet.

10. The staging apparatus of claim 9, wherein the lid means and the container cooperate to define means for venting the interior region of the container to dissipate heat developing in the container due to a high ambient temperature inside of the container.

11. The staging apparatus of claim 9, wherein the container includes a bottom wall coupled to the base means and a plurality of side walls appended to the bottom wall, the lid means includes a closure member and means for moving the closure member between a lowered position to hold the closure means in spaced-apart relation to a top edge of one of the side walls to define a venting aperture therebetween to discharge heat developing in the container due to high ambient temperature inside of the container while the loading inlet is closed by the lid means.

12. The staging apparatus of claim 1, wherein the dispensing means includes means for storing a collection of banking service materials inside the remote service unit and means for exposing banking service materials in the storing means to an occupant of a vehicle positioned alongside the remote service unit.

13. The staging apparatus of claim 12, wherein the storing means includes an inclined shelf.

14. The staging apparatus of claim 13, wherein the remote service unit includes a side wall facing toward a vehicle positioned alongside the remote service unit and detected by the sensing means, the side wall is formed to include a discharge outlet, and the inclined shelf is arranged to provide means for conducting banking service materials stored thereon under gravity toward the discharge outlet.

15. The staging apparatus of claim 14, wherein the exposing means includes a gate mounted on the side wall and movable between a discharge outlet-opening position and a discharge outlet-closing position.

16. A banking services staging apparatus for readying a banking customer traveling in a vehicle to use a drive-through bank teller station in advance of reaching the teller station, the apparatus comprising a remote service unit separate from an adjacent drive-through bank teller station, means for providing a message to a vehicle upon movement of the vehicle to a predetermined position alongside the remote service unit, and means for dispensing banking services materials to an occupant of a vehicle positioned alongside the remote service unit and detected by a sensing means.

17. The staging apparatus of claim 16, wherein the providing means include the sensing means, which senses the presence of a vehicle positioned alongside the remote service unit, the sensing means being located in the remote service unit, and means for presenting a message to a vehicle detected by the sensing means, the presenting means being located in the remote service unit.

18. The staging apparatus of claim 16, wherein the remote service unit includes a container and base means for supporting the container at an elevated position above a roadway and remote from an adjacent drive-through bank teller station so that the container is accessible to an occupant seated in a vehicle positioned alongside the remote service unit.

19. A staging, apparatus of claim 18, wherein the providing means includes the sensing means, which senses the presence of a vehicle positioned alongside the remote service unit, the sensing means being located in the container, and means for presenting a message to a vehicle detected by the sensing means, the presenting means being located in the container.

20. The staging apparatus in claim 18, further comprising a back lit message display panel mounted on the container and means in the container for projecting light simultaneously onto the back lit message panel on the container and onto the base means underlying the container.

21. The staging apparatus of claim 20, wherein the container is formed to include an interior region and includes a first side wall arranged to face toward a vehicle positioned alongside the remote service unit and a second side wall arranged at an angle to the first side wall to face toward a vehicle approaching the remote service unit, the back lit message display panel is mounted on the second side wall, and the projecting means is mounted in the interior region of the container.

22. The staging apparatus of claim 18, wherein the dispensing means is mounted in the container.

23. The staging apparatus of claim 22, wherein the container is formed to include an interior region and includes a first side wall arranged to face a vehicle positioned alongside the remote service unit, the first side wall is formed to include a discharge outlet and the dispensing means includes means for storing a collection of banking service materials inside the interior region adjacent to the discharge outlet formed in the first side wall and a gate mounted on the first side wall and moveable between a discharge outlet-opening position and a discharge outlet-closing position.

24. The staging apparatus of claim 22, wherein the dispensing means includes means for storing a collection of banking service materials inside the remote service unit and means for exposing bank service materials in the storing means to an occupant of a vehicle positioned alongside the remote service unit.

25. The staging apparatus of claim 24, wherein the dispensing means is slidably supported allowing the material adjacent the exposing means to move in an upward and downward motion to accommodate banking materials of various sizes.

26. The staging apparatus of claim 18, wherein the dispensing means includes means for storing a collection of banking service materials inside an interior region in the container, and the container is formed to include a discharge outlet accessible to an occupant of a vehicle positioned alongside the remote service unit, and a loading inlet facing away from the discharge outlet and includes lid means for selectively opening the loading inlet formed in the container to permit a person standing alongside the remote service unit to gain access to banking service materials contained in the storing means, and the dispensing means further includes closure means for selectively opening the discharge outlet formed in the container to permit an occupant of a vehicle positioned alongside the remote service unit to gain access to banking service materials contained in the storing means without using the lid means to open the loading inlet.

27. The staging apparatus of claim 26, wherein the lid means and the container cooperate to define means for venting the interior region of the container to dissipate heat developing in the container due to a high ambient temperature inside of the container.

28. The staging apparatus of claim 26, wherein the container includes a bottom wall coupled to the base means and a plurality of side walls appended to the bottom wall, the lid means includes a closure member and means for moving the closure member between a lowered position to hold the closure means in spaced-apart relation to a top edge of one of the side walls to define a venting aperture therebetween to discharge heat developing in the container due to high ambient temperature inside of the container while the loading inlet is closed by the lid means.

29. The staging apparatus of claim 16, wherein the dispensing means includes means for storing a collection of banking service materials inside the remote service unit and means for exposing banking service materials in the storing means to an occupant of a vehicle positioned alongside the remote service unit.

30. The staging apparatus of claim 29, wherein the storing means includes an inclined shelf.

31. The staging apparatus of claim 30, wherein the remote service unit includes a side wall facing toward a vehicle positioned alongside the remote service unit, the side wall is formed to include a discharge outlet, and the inclined shelf is arranged to provide means for conducting banking service materials stored thereon under gravity toward the discharge outlet.

* * * * *